US007753757B2

(12) United States Patent
Shinomiya

(10) Patent No.: US 7,753,757 B2
(45) Date of Patent: Jul. 13, 2010

(54) UPPER UNDERWEAR

(75) Inventor: Yumi Shinomiya, Kobe (JP)

(73) Assignee: Indy & Associate, Kobe-shi (JP)

( * ) Notice: Subject to any disclaimer, the term of this patent is extended or adjusted under 35 U.S.C. 154(b) by 199 days.

(21) Appl. No.: 11/573,876

(22) PCT Filed: Sep. 12, 2005

(86) PCT No.: PCT/JP2005/016743

§ 371 (c)(1),
(2), (4) Date: Oct. 15, 2007

(87) PCT Pub. No.: WO2006/054382

PCT Pub. Date: May 26, 2006

(65) Prior Publication Data

US 2008/0070478 A1 Mar. 20, 2008

(30) Foreign Application Priority Data

Nov. 22, 2004 (JP) ..... 2004-337233

(51) Int. Cl.
*A41C 3/00* (2006.01)

(52) U.S. Cl. ..... 450/75; 450/74

(58) Field of Classification Search ..... 450/70, 450/71, 74–76, 79, 82, 83, 84, 85, 62, 63, 450/64

See application file for complete search history.

(56) References Cited

U.S. PATENT DOCUMENTS 6,790,122 B2 * 9/2004 Mitchell et al. ..... 450/66
6,899,591 B2 * 5/2005 Mitchell ..... 450/65
6,918,812 B2 * 7/2005 Giese ..... 450/65
2003/0171066 A1 9/2003 Mitchell et al.

FOREIGN PATENT DOCUMENTS

| | | |
|---|---|---|
| CA | 2 389 092 A1 | 12/2002 |
| JP | 58-38704 | 3/1983 |
| JP | 3017074 | 10/1995 |
| JP | 09-095806 | 4/1997 |
| JP | 3042861 | 11/1997 |
| JP | 2001-115305 | 4/2001 |
| JP | 2002-212805 | 7/2002 |
| JP | 2002-294503 | 10/2002 |

OTHER PUBLICATIONS

International Search Report for International Application No. PCT/JP2005/016743, mailed Dec. 6, 2005.
Extended European Search Report for EP Application No. 05782395.7-2314, dated Feb. 11, 2010.

* cited by examiner

*Primary Examiner*—Gloria Hale
(74) *Attorney, Agent, or Firm*—Marshall, Gerstein & Borun LLP

(57) ABSTRACT

Upper underwear includes: right and left cups for accommodating respective breasts therein; a coupling member coupling the cups to each other, and a belt joined to the cups, wherein: the belt has belt side portions to be positioned on side parts of a body when the underwear is put on the body, and a belt back portion to be positioned on a back part of the body when the underwear is put on the body; and the belt is formed such that when the upper underwear is put on the body, a lower edge of said belt back portion is positioned above a lower end level of said cups, whereby a sensation of pressure imparted to the body by the upper underwear can be relieved.

11 Claims, 7 Drawing Sheets

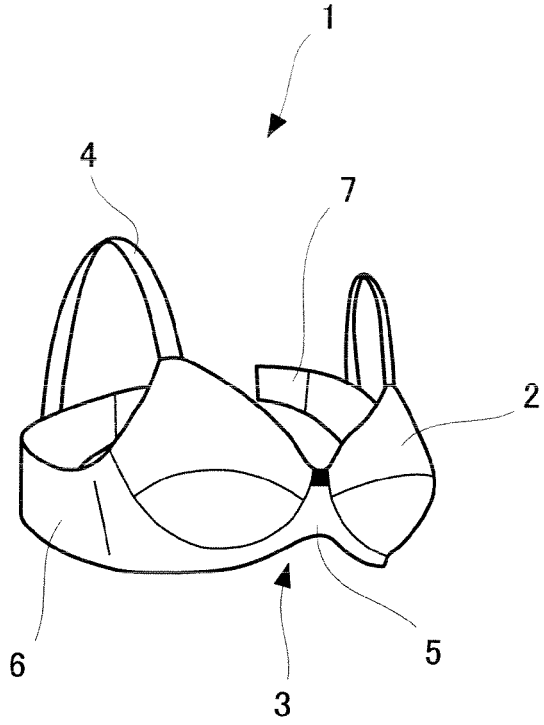
Fig. 1(a)
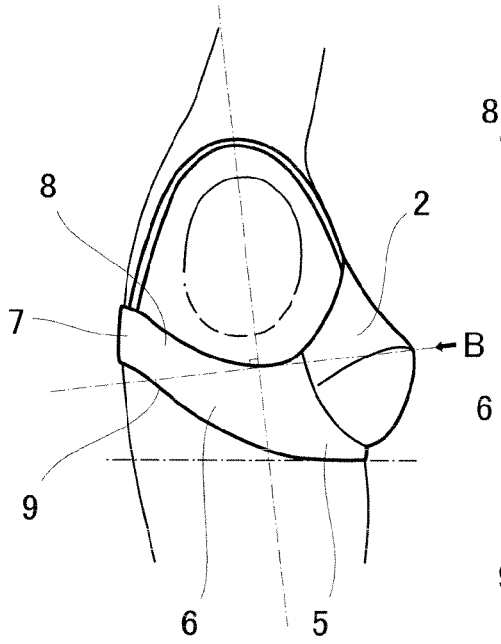
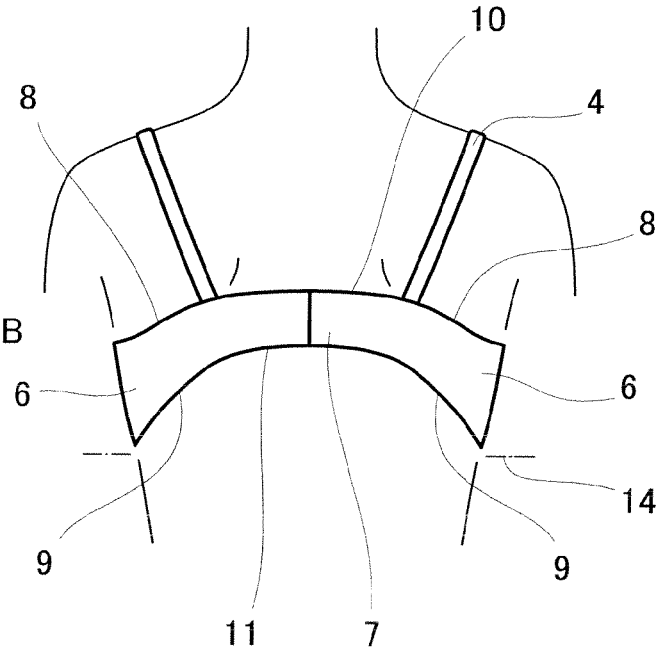
Fig. 1(b) Fig. 1(c)

MEASUREMENT DIFFERENCES AT DIFFERENT PARTS OF THE BODY BREATHING cm

| | |
|---|---|
| CENTER FRONT OF THE BODY (MEASUREMENT DIFFERENCE a) | 1. 5~2 |
| SIDE POSITION (MEASUREMENT DIFFERENCE b) | 0 |
| CENTER BACK OF THE BODY (SCALPULA LEVEL) (MEASUREMENT DIFFERENCE c) | 0. 1~0. 2 |
| CENTER BACK OF THE BODY (UNDERBUST LINE LEVEL) (MEASUREMENT DIFFERENCE d) | 0. 5~0. 7 |

UPPER UNDERWEAR

TECHNICAL FIELD

The invention of the instant application relates to shapes and materials of such underwear as brassieres.

BACKGROUND ART

Conventionally, a brassiere 23 as upper underwear has brassiere cups 24 to be put on the breasts to cover breast parts and fixed to the bust by means of belt side portions 27 of belt 25, belt back portion 28 and straps 26 in order to dress the bust of a woman esthetically, as shown in FIG. 7. For the bust to be shown more beautifully, there have been invented brassieres of the type configured to put the breasts up and closer to each other in a manner to protrude them in front, and brassieres of the correcting type (see Japanese Patent Laid-Open Publication No. HEI 9-95806 for example). Because such brassieres of the type configured to put the breasts up and closer to each other sometimes make the user to feel pressure or tightness during exercise or breathing, a brassiere using plural materials that are different in stretchability from each other for the user to feel lessened tightness (see Japanese Registered Utility Model Publication No. 3042861 for example). As mentioned above, brassieres with partial improvements associated with cup shape and stretchable materials have already been invented.

However, a brassiere that is modified only in its material cannot sufficiently accommodate expansion and contraction of the chest (particularly, parts adjacent the ribs) during exercise or breathing. For this reason, such a brassiere cannot make the user feel free of pressure or tightness.

DISCLOSURE OF INVENTION

In view of the foregoing problem, it is an object of the present invention to provide upper underwear which makes the user feel a relieved sensation of pressure or tightness even if put on for a prolonged time.

In order to solve the foregoing problem, the present invention provides upper underwear comprising right and left cups for accommodating respective breasts therein, and a belt joined to the cups, wherein: the belt has belt side portions to be positioned on side parts of a body when the underwear is put on the body, and a belt back portion to be positioned on a back part of the body when the underwear is put on the body; and the belt is formed such that the belt back portion is positioned above a line connecting tops of respective of the right and left cups when the upper underwear is placed on a flat surface with the belt folded at side positions coinciding with the side parts of the body to lie under the cups, whereby the tightening force of the upper underwear working on the chest can be reduced.

The present invention also provides upper underwear comprising right and left cups for accommodating respective breasts therein, a coupling member coupling the cups to each other, and a belt joined to the cups, wherein: the belt has belt side portions to be positioned on side parts of a body when the underwear is put on the body, and a belt back portion to be positioned on a back part of the body when the underwear is put on the body; and the belt is formed such that when the upper underwear is put on the body, a lower edge of the belt back portion is positioned above a lower end level of the cups at which movement of the body is small during breathing or exercise, whereby the tightening force of the upper underwear working on the chest can be reduced more reliably.

If straps are attached to the cups and to the belt back portion, the tightening force on the chest can be decentralized.

If each of the belt side portions has a side upper edge forming an upper edge thereof and a side lower edge forming a lower edge thereof, each of which is curved upwardly to describe a substantially partial ellipse, side parts of the body can be fixed stably.

If the belt back portion is formed so as to position the lower edge thereof on scapulas, the tightening force on the chest can be reduced further.

If the upper underwear is provided with: a first stretchable portion in a portion of the belt that extends downwardly from a position at which the right and left cups are coupled to each other; a second stretchable portion in a portion of the belt other than the first stretchable portion that extends downwardly from the lower end of each of the cups; a low-stretchability portion in each of the belt side portions that is continuous with the second stretchable portion, and a third stretchable portion in a portion of the belt that is located intermediate the right and left low-stretchability portions, the chest tightening force can be reduced further by both of the structure and the material of the upper underwear.

If the belt back portion is formed so as to be positioned above the lower end level of the cups when the upper underwear is put on the body, the breasts can be supported by the belt back portion also and, hence, the force working on the straps can be decentralized. Further, the use of the material having portions which are different in stretchability from each other allows the user to breathe easily not only during breathing but also during exercise. The arrangement described above can make the user feel a relieved sensation of pressure or tightness even if the upper underwear is put on the user for a prolonged time.

The foregoing and other objects, features and attendant advantages of the present invention will become more apparent from the reading of the following detailed description of the preferred embodiments in conjunction with the accompanying drawings.

BRIEF DESCRIPTION OF DRAWINGS

FIG. 1 illustrates a brassiere as upper underwear according to the present invention; specifically, FIGS. 1(*a*), 1(*b*) and 1(*c*) are a perspective view, a right side view and a rear view, respectively, of the brassiere.

Figure 5A:
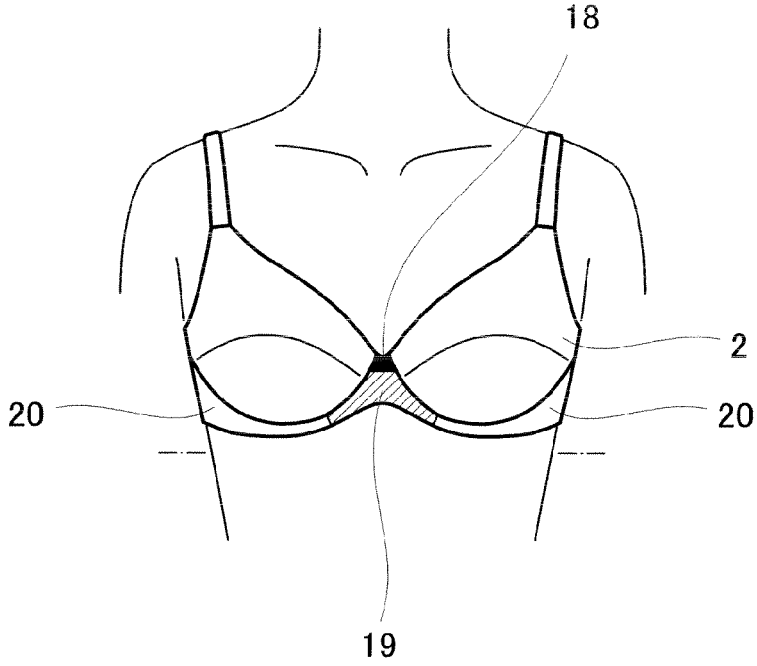
FIG. 5 illustrates the positions of different materials used in the brassiere as the upper underwear of the present invention.
Figure 5B:
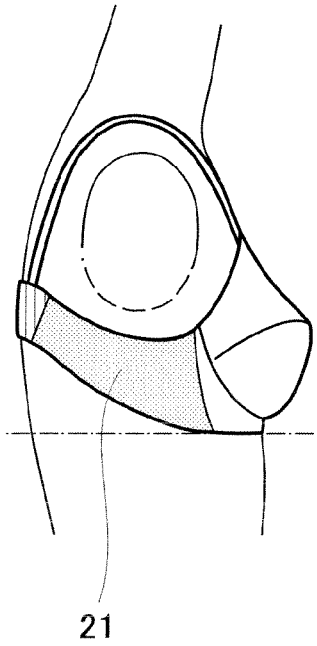
Figure 5C:
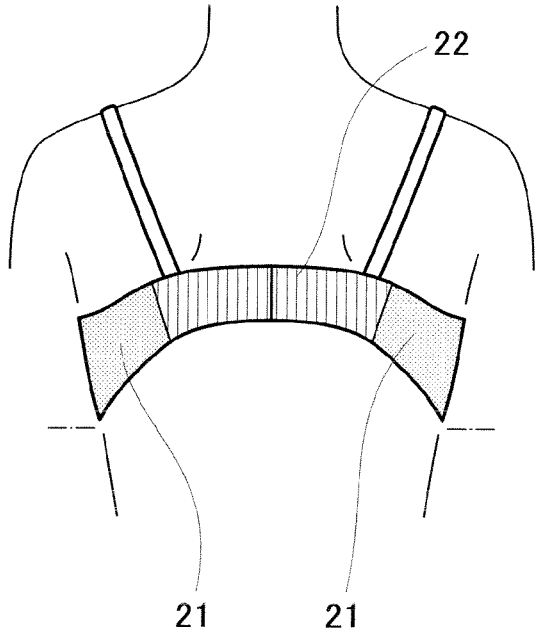

specifically, FIGS. 5(*a*), 5(*b*) and 5(*c*) are a front view, a right side view and a rear view, respectively, of the brassiere.

Figure 6A:
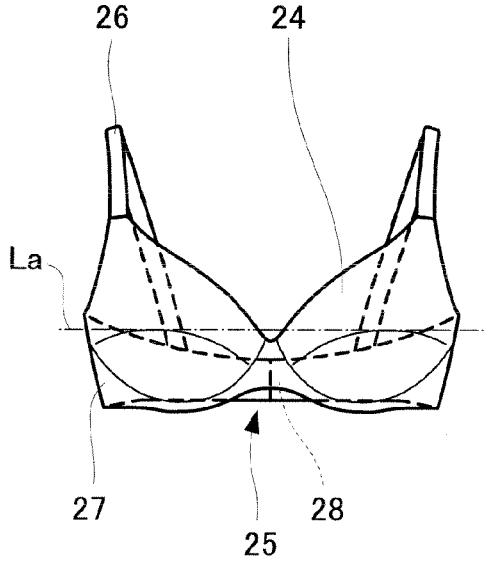
Figure 6B:
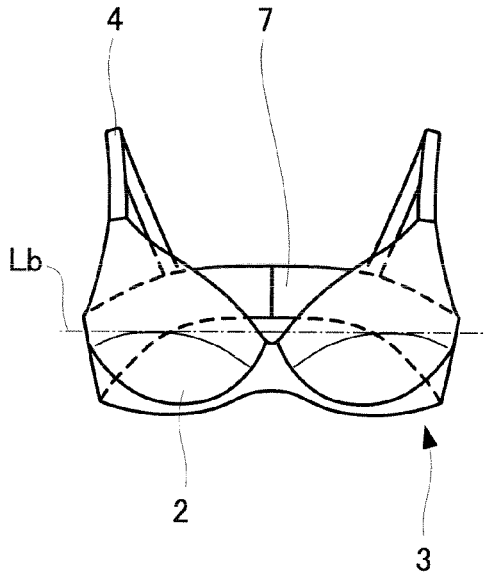
Figure 7A:
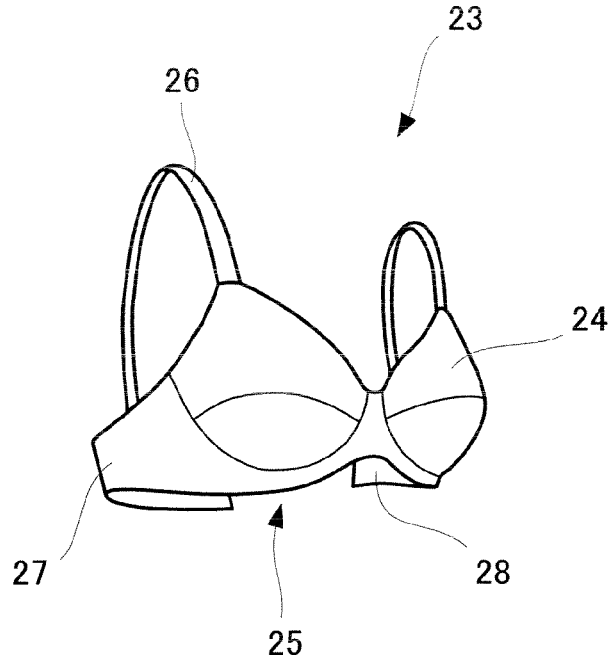
Figure 7B:
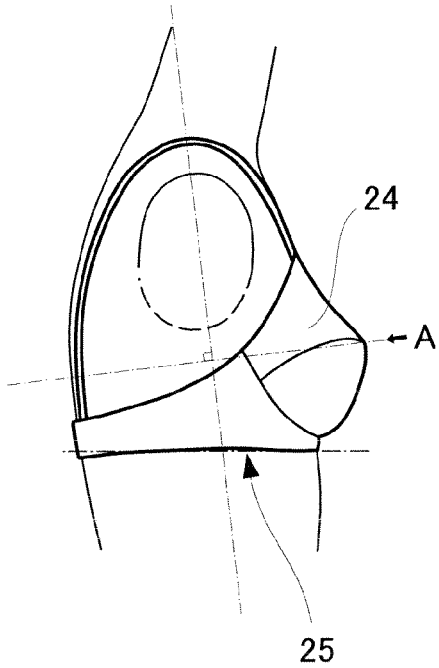
Figure 7C:
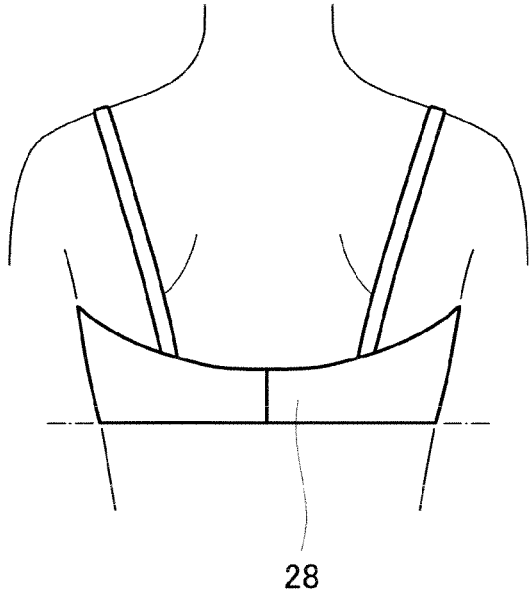

FIG. 6 illustrates a brassiere as upper underwear in a condition placed on a flat surface, such as of a desk, with the belt folded at side positions so as to underlie the cups; specifically, FIG. 6(*a*) shows the conventional brassiere as viewed from the direction indicated by arrow A in FIG. 7 and FIG. 6(*b*) shows the brassiere of the present invention as viewed from the direction indicated by arrow B in FIG. 1.

FIG. 7 illustrates the conventional brassiere as upper underwear; specifically, FIGS. 7(*a*), 7(*b*) and 7(*c*) are a perspective view, a right side view and a rear view, respectively, of the brassiere.

BEST MODE FOR CARRYING OUT THE INVENTION

One embodiment of upper underwear according to the present invention will be described with reference to the drawings.

FIG. 1 illustrates a brassiere as upper underwear according to the present invention; specifically, FIGS. 1(*a*), 1(*b*) and 1(*c*) are a perspective view, a right side view and a rear view, respectively, of the brassiere.

As shown in FIG. 1(*a*), the brassiere 1 includes hemispherical cups 2 for covering breasts, a band-like belt 3 for fixing the cups 2 to the chest of a body, and strip-shaped straps 4 for fixedly suspending the cups 2 from the shoulders. Cup types of the cups 2 include a full-cup type, a ¾-cup type, a half-cup type, and like types to be used depending on the design, comfortableness or the like of the cups in a put-on condition. Regardless of the type of the cups 2, an upper edge of a portion of the belt 3 situated adjacent the center of the belt 3 is joined with lower ends of the lower halves of the cups 2. The cups 2 can be fixed to the body by hooking-up the belt 3 with a non-illustrated hook (rear ring) provided on a back portion of the belt 3. The straps 4 extend from the upper ends of the respective cups 2 to the back portion of the belt 3 via the chest and the shoulders to sustain the load imposed on the cups 2 by the breasts. The brassiere of such a structure is capable of stably fixing the breasts in position.

The belt 3 comprises a belt front portion 5 situated under and adjacent the cups 2, belt side portions 6 which are continuous with the belt front portion 5 and are positioned adjacent side parts of the body, and a belt back portion 7 which is continuous with the belt side portions 6 and is positioned adjacent a back part of the body. The belt front portion 5 is substantially flared to have an upper edge joined with the cups 2 and a substantially linear lower edge, thereby stabilizing the positions of the cups 2 while failing to interfere with breathing or body movements. As shown in FIG. 1(*b*), the width of each belt side portion 6 between a side upper edge 8 forming the upper edge of the belt side portion 6 and a side lower edge 9 forming the lower edge of the belt side portion 6 is maximized at a location adjacent to a respective one of the cups 2 and tapered as the belt side portion 6 extends toward the back part. The belt side portions 6 thus shaped are capable of fixing the side parts of the body unforcibly. The side upper edge 8 is curved upwardly to describe a substantially partial ellipse in such a manner to make a detour around the root of an arm in order to avoid its interference with movements of the arm. Similarly, the side lower edge 9 is curved to describe a substantially ellipse corresponding to the shape of the side upper edge 8. As shown in FIG. 1(*c*), a back upper edge 10 forming the upper edge of the belt back portion 7 and a back lower edge 11 forming the lower edge of the belt back portion 7 are joined with the side upper edge 8 and the side lower edge 9, respectively. Of portions of the belt 3 located adjacent the joint between the back upper edge 10 and the side upper edge 8 and the joint between the back lower edge 11 and the side lower edge 9, at least a portion located on the upper edge side is formed so as to be positioned above the most protuberant part of a scapula. Also, each of the straps is attached to a portion of the belt 3 located adjacent the joint between the back upper edge 10 and the side upper edge 8. Such an arrangement makes it possible to lift up the breasts by the belt only.

Figure 2A:
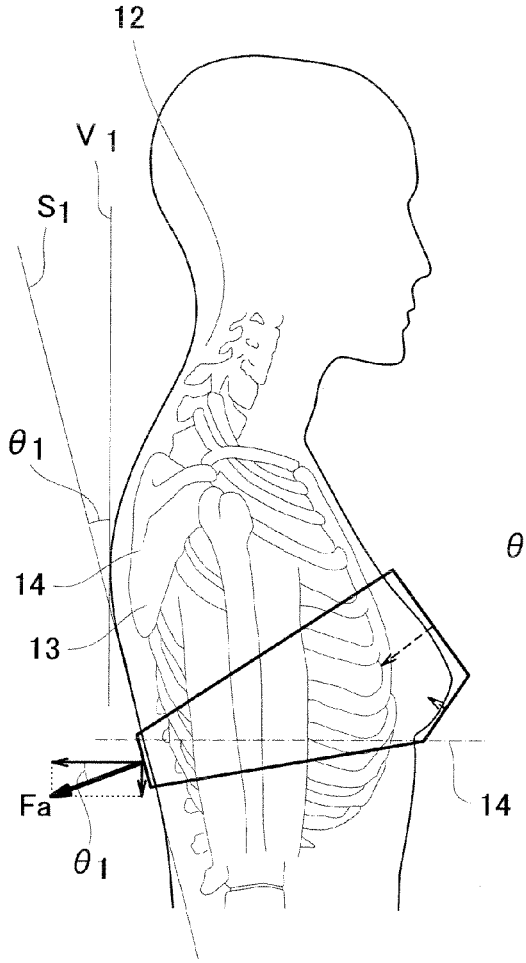
FIG. 2 imaginarily illustrates, in right side view, forces working on a brassiere as upper underwear in a put-on condition; specifically, FIG. 2(*a*) illustrates such forces working on a conventional brassiere in the put-on condition and FIG. 2(*b*) illustrates such forces working on the brassiere of the present invention in the put-on condition.
Figure 2B:
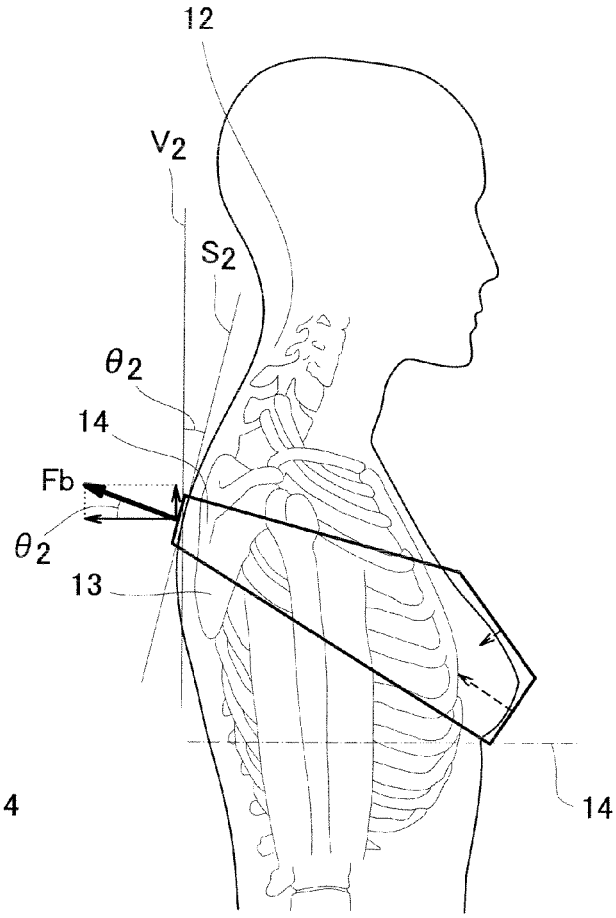

FIG. 2 imaginarily illustrates, in right side view, forces working on a brassiere as upper underwear in a put-on condition; specifically, FIG. 2(*a*) illustrates such forces working on a conventional brassiere in the put-on condition and FIG. 2(*b*) illustrates such forces working on the brassiere of the present invention in the put-on condition.

In FIG. 2, a solid arrow indicates a force received by the brassiere 1 from the body and a dotted arrow indicates a force received by the body from the brassiere 1. As shown in FIG. 2(*a*), the brassiere 1 in the put-on condition receives a counterforce Fa working on the belt back portion 7 from the body. Here, brief description is directed to the profile of the back of a human. The profile of a human's body gently rearwardly protrudes from a neck part 12 down to the scapula 13 and then returns forwardly from the scapula 13. Assuming that the angle formed between a tangent line S1 which is tangential to a body part coinciding with the belt back portion 7 of the brassiere 1 and a vertical line V1 passing this body part and extending to the ground is θ1, the counterforce Fa works on the brassiere 1 in a direction that is downwardly inclined relative to the horizontal direction by the angle θ1 when the back lower edge 11 is positioned on the same level as an underbust line 14 or lower. The counterforce Fa acts to press the belt back portion 7 of the brassiere 1 downwardly, hence, displace the brassiere 1 downwardly. Thus, the force received by the body from the cups of the brassiere acts to depress the upper parts of the breasts from above rather than press up the lower parts of the breasts from below, thereby collapsing the breasts. In order to reduce such a force received by the body from the brassiere, the straps 4 or the like are provided to prevent the occurrence of such displacement by the shoulders. However, the provision of the straps 4 for preventing the occurrence of such displacement causes part of the counterforce Fa to work on the shoulders, thus causing the shoulders to stiffen or a like demerit to arise.

As shown in FIG. 2(*b*), on the other hand, assuming that the angle formed between a tangent line S2 which is tangential to the body part coinciding with the belt back portion 7 of the brassiere 1 and a vertical line V2 passing this body part and extending to the ground is θ2, a counterforce Fb works on the brassiere 1 in a direction that is upwardly inclined relative to the horizontal direction by the angle θ2 when the back lower edge 11 is positioned above the protuberant part 14 of the scapula 13. The counterforce Fb acts to press the belt back portion 7 of the brassiere 1 upwardly, hence, prevent the brassiere 1 from being displaced.

This force acts to reduce the force working on the straps 4 on the shoulders, thereby making it possible to relieve shoulder stiffness and the like. Further, the force received by the body from the brassiere acts to press up the lower parts of the breasts from below rather than depress the upper parts of the breasts from above, thereby pressing the breasts up naturally. By thus changing the positioning of the belt back portion 7, it is possible to relieve shoulder stiffness and the like. The causes of pressure or tightness on the body other than described above include those associated with pressure on the chest to be described below.

Figures 3A, 3B:
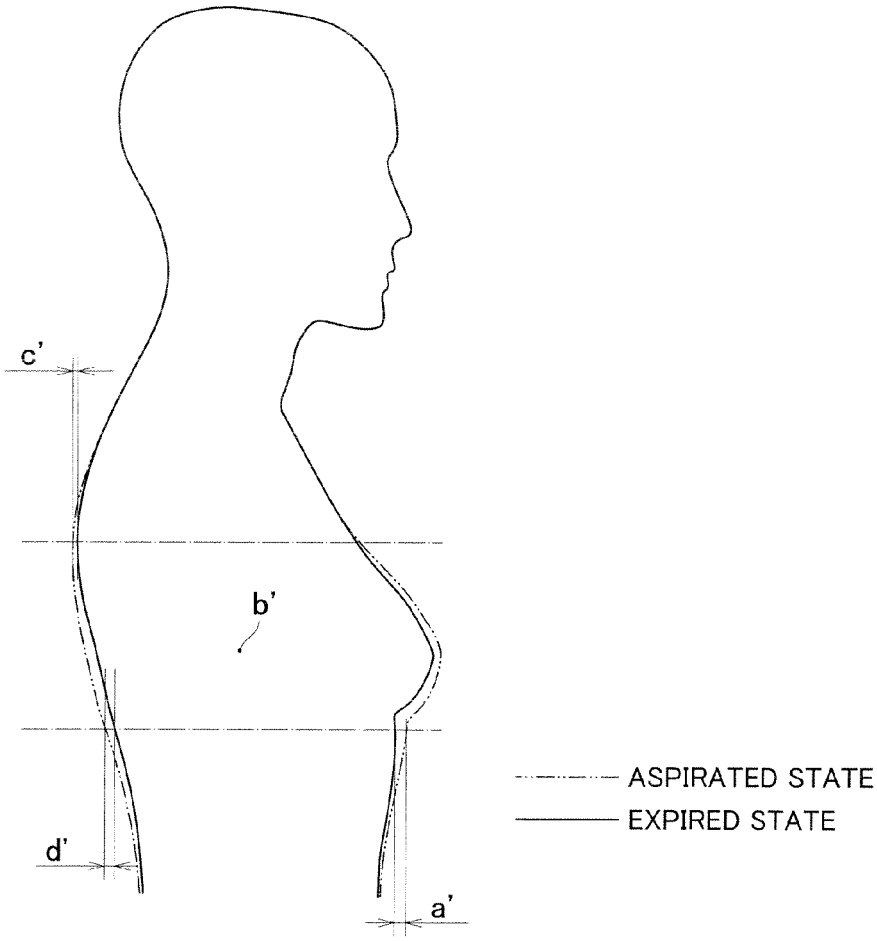
FIG. 3 illustrates the chest changing with breathing; specifically, FIG. 3(*a*) is a view illustrating the body changing between an aspirated state and an expired state and FIG. 3(*b*) is a table showing measurement differences at different parts of the body.

FIG. 3 illustrates the chest changing with breathing; specifically, FIG. 3(*a*) is a view illustrating the body changing between an aspirated state and an expired state and FIG. 3(*b*) is a table showing measurement differences at different parts of the body.

As shown in FIG. 3, measurement differences at different parts of the bust breathing include: a measurement difference a of 1.5 to 2 cm at a center front of the body (a difference in measurement circumferential of the chest corresponding to a measurement difference a' in the right sectional view); a measurement difference b of 0 cm (substantially no change) at a side position (a difference in measurement circumferential of the chest corresponding to a measurement difference b' in the right sectional view); a measurement difference c of 0.1 to 0.2 cm at a scapula level (center back of the body) (a difference in measurement circumferential of the chest corresponding to a measurement difference c' in the right sectional view); and a measurement difference d of 0.5 to 0.7 cm at an underbust level (center back of the body) (a difference in measurement circumferential of the chest corresponding to a measurement difference d' in the right sectional view). As can be understood from this table, a difference in a measurement of the brassiere 1 having the belt back portion 7 positioned on the scapula level due to expansion/contraction of the brassiere 1 is smaller than that in the measurement of the brassiere 1 having the belt back portion 7 positioned on the underbust level due to expansion/contraction of the brassiere 1. That is, the tightening force (elastic force) of the belt 3 having the belt back portion 7 positioned on the scapula level, which works on the body due to expansion of the upper part of the body breathing, is smaller than that of the belt 3 having the back portion 7 positioned on the underbust level. Therefore, the positioning of the belt back portion 7 on the scapula level makes it possible to relieve a sensation of pressure imparted to the user breathing.

Figure 4A:
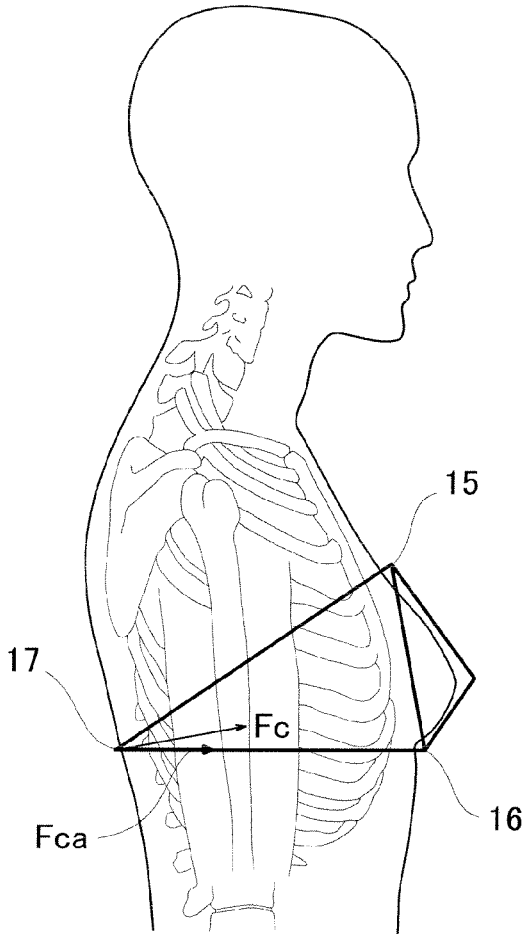
FIG. 4 imaginarily illustrates, in right side view, forces tightening the chest when a brassiere as upper underwear is in a put-on condition; specifically, FIG. 4(*a*) illustrates such forces working on the chest when the conventional brassiere is in the put-on condition and FIG. 4(*b*) illustrates such forces working on the chest when the brassiere of the present invention is in the put-on condition.
Figure 4B:
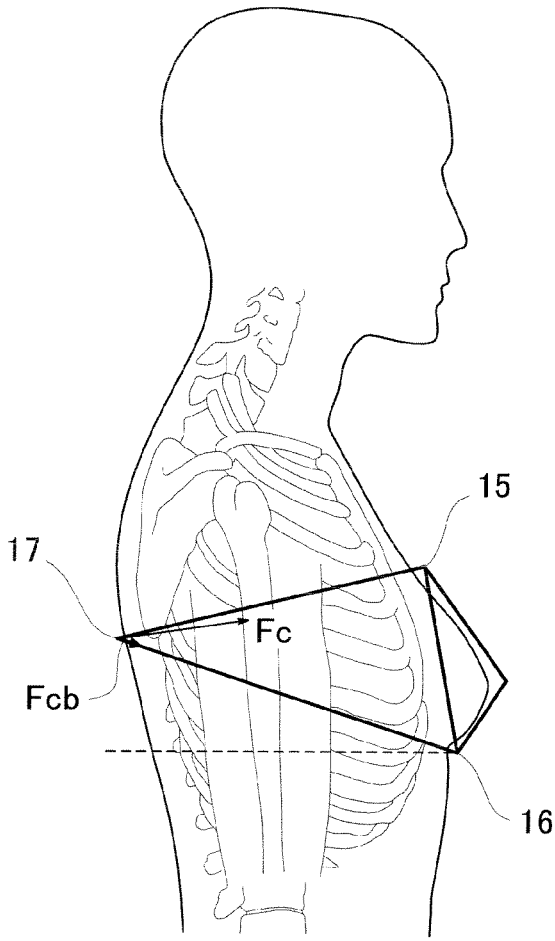

FIG. 4 imaginarily illustrates, in right side view, forces tightening the chest when a brassiere as upper underwear in a put-on condition; specifically, FIG. 4(*a*) illustrates such forces working on the chest when the conventional brassiere is in the put-on condition and FIG. 4(*b*) illustrates such forces working on the chest when the brassiere of the present invention is in the put-on condition.

In the case where the belt 3 is positioned on the underbust level as shown in FIG. 4(*a*), consideration is given to a triangle connecting a cup upper end 15 forming the upper end of the cups, a cup lower end 16 forming the lower end of the cups, and a back position 17 of the belt back portion. A force Fc received by the back of the body is decomposed into a force working in the direction along the line connecting the cup upper end 15 and the back position 17 which forms the upper side of the triangle and a force working in the direction along the line connecting the cup lower end 16 and the back position 17 which forms the lower side of the triangle. In this case, the tightening force of the belt 3 working in the direction along the lower side of the triangle, i.e., the underbust line, is larger and, hence, the user feels a large pressure on the chest during breathing. On the other hand, in the case where the back position 17 is moved to above the underbust line level as shown in FIG. 4(*b*), the force Fc received by the back of the body is decomposed into a force working in the direction along the line connecting the cup lower end 16 and the back position 17 and a force working in the direction along the line connecting the cup upper end 15 and the back position 17. In this case, the force working in the direction along the line connecting the cup lower end 16 and the back position 17 is smaller than that working in the direction along the line connecting the cup upper end 15 and the back position 17. Accordingly, the tightening force of the lower edge of the belt is lower than in the former case and, hence, the user feels a decreased pressure on a body part that changes most largely with breathing (the part corresponding to the lower edge of the belt). When comparison is made between the force working in the direction from the back position 17 toward the cup lower end 16 in FIG. 4(*a*) and the force working in the direction from the back position 17 toward the cup lower end 16 in FIG. 4(*b*), Fca is larger than Fcb, or Fca>Fcb even if equal force works in the direction from the back position 17 toward the cup lower end 16 because the length of the line connecting the back position 17 and the cup lower end 16 in FIG. 4(*a*) is smaller than the length of the line connecting the back position 17 and the cup lower end 16 in FIG. 4(*b*). Such a change of body (a measurement difference between the aspirated state and the expired state during deep breathing) results in a difference of 4.0 to 5.0 cm in the measurement of the circumference of the lower edge of the belt in the case of FIG. 4(*a*) and in a difference of 1.5 to 2.0 cm in the measurement of the circumference of the lower edge of the belt in the case of FIG. 4(*b*). As can be understood therefrom, by moving the back position 17 toward the upper side, it is possible to avoid tightening the body part that changes most largely as well as to relieve the sensation of pressure on the body. The following description is directed to materials that are used in the brassiere 1 in order to further reduce the tightening force.

FIG. 5 illustrates the positions of different materials used in the brassiere as the upper underwear of the present invention; specifically, FIGS. 5(*a*), 5(*b*) and 5(*c*) are a front view, a right side view and a rear view, respectively, of the brassiere.

As shown in FIG. 5, the right and left cups 2 are each formed into a three-dimensional shape, and various materials are used for the cups regardless of their stretchability. The right and left cups 2 are coupled to each other by means of an intervening coupling member 18 having no stretchability to maintain the positional relation between the right and left cups 2 even when the body (the measurement of the chest) changes with breathing or during exercise. A substantially triangular portion of the belt front portion 5 which is downwardly continuous with the coupling member 18 and with the right and left cups 2 comprises a first stretchable portion 19 (comprising a highly stretchable material) so as to be capable of accommodating the measurement difference at the center front of the body shown in FIG. 3(*b*). Each of the portions that are situated outwardly of the first stretchable portion 19 and extend under the right and left cups 2 comprises a second stretchable portion 20 (comprising material having somewhat high stretchability) so as to be capable of accommodating the measurement difference at a position adjacent the center front of the body shown in FIG. 3(*b*). Each of the portions extending rearwardly from respective of the right and left second stretchable portions 20 comprises a low-stretchability portion 21 (comprising a material having a low stretchability) so as to stabilize a respective one of the side parts which are most stable and have the smallest measurement difference of measurement differences at the circumferential parts of the chest. Further, the portion which is positioned adjacent the back of the body to link the right and left low-stretchability portions 21 comprises a third stretchable portion 22 (comprising a stretchable material) so as to be capable of accommodating the measurement difference at the center back of the body shown in FIG. 3(*b*). With respect to the stretchabilities of respective of the first, second and third stretchable portions 19, 20 and 22 and the low-stretchability portion 21, the relationship: first stretchable portion 19>second stretchable portion>third stretchable portion 22>low-stretchability portion 21 holds. Therefore, the first stretchable portion 19 is the most stretchable and the low-stretchability portion 21 is the poorest in stretchability.

FIG. 6 illustrates a brassiere as upper underwear in a condition placed on a flat surface, such as of a desk, with the belt folded at side positions so as to underlie the cups; specifically, FIG. 6(*a*) shows the conventional brassiere as viewed from the direction indicated by arrow A in FIG. 7 and FIG. 6(*b*) shows the brassiere of the present invention as viewed from the direction indicated by arrow B in FIG. 1.

When the conventional brassiere taken off the body is placed on a flat surface, such as of a desk, with the belt folded at side positions so as to underlie the cups as shown in FIG. 6(*a*), a belt back portion 28 is positioned below a line La connecting the tops of right and left cups 24. In the case of the brassiere of the present invention, in contrast, the belt back portion 7 is positioned above the line Lb connecting the tops of right and left cups 2.

It is to be noted that the present invention is not limited to this embodiment. For example, instead of the rear hook (rear ring) used as the fastening member in putting the brassiere 1 on the body, a front hook, which also serves as the aforementioned coupling member, may be used. Also, the present invention in no way intends to exactly delimit the ranges in which the respective stretchable portions are provided.

It will be apparent from the foregoing description that many improvements and other embodiments of the present invention may occur to those skilled in the art. Therefore, the foregoing description should be construed as an illustration only and is provided for the purpose of teaching the best mode for carrying out the present invention to those skilled in the art. The details of the structure and/or the function of the present invention can be modified substantially without departing from the spirit of the present invention.

INDUSTRIAL APPLICABILITY

The upper underwear of the present invention is capable of providing a brassiere which is formed to have a shape related to the figure and function (change of body during breathing or exercise) of a body thereby making it possible to relieve a sensation of pressure or tightness as well as to lift up the breasts, abdomen and the back naturally. Further, the present invention is useful in the technical field of women's underwear including brassieres because the upper underwear of the present invention allows user's ability of exercise to be improved by relieving muscle strain and assists in improving the blood circulation to relieve symptoms caused by bad blood circulation such as shoulder stiffness thereby preventing the capability of the whole body from lowering.

The invention claimed is:

1. Upper underwear comprising: right and left cups for accommodating respective breasts therein; and a belt joined to said cups, wherein:

said belt has belt side portions to be positioned on side parts of a body when the underwear is put on the body, and a belt back portion to be positioned on a back part of the body when the underwear is put on the body; and said belt is formed such that said belt back portion is positioned above a line connecting tops of respective of said right and left cups when the upper underwear is placed on a flat surface with said belt folded at side positions coinciding with the side parts of the body to lie under said cups;

a coupling member coupling said right and left cups to one another, the coupling member having no stretchability and arranged to maintain a positional relationship between said cups;

the belt including a first stretchable portion which is of a substantially triangular shape and is continuous with an underside of a coupled portion of said right and left cups;

the belt further including right and left second stretchable portions each continuous with a corresponding outer side of the first stretchable portion and continuous to an underside of a corresponding one of the right and left cups;

the belt further including a low-stretchability portion provided in a portion of each of said belt side portions and that is continuous with a corresponding one of said right and left second stretchable portions;

the belt further including a third stretchable portion disposed between and operatively coupling the right and left low-stretchability portions to one another; and wherein stretchability decreases in the order of the first stretchable portion, the second stretchable portion, the third stretchable portion and the low-stretchability portion.

2. Upper underwear comprising: right and left cups for accommodating respective breasts therein; and a belt joined to said cups, wherein:

said belt has belt side portions to be positioned on side parts of a body when the underwear is put on the body, and a belt back portion to be positioned on a back part of the body when the underwear is put on the body; and said belt is formed such that when the upper underwear is put on the body, a lower edge of said belt back portion is positioned above a lower end level of said cups at which movement of the body is small during breathing or exercise;

a coupling member coupling said right and left cups to one another, the coupling member having no stretchability and arranged to maintain a positional relationship between said cups;

the belt including a first stretchable portion which is of a substantially triangular shape and is continuous with an underside of a coupled portion of said right and left cups;

the belt further including right and left second stretchable portions each continuous with a corresponding outer side of the first stretchable portion and continuous to an underside of a corresponding one of the right and left cups;

the belt further including a low-stretchability portion provided in a portion of each of said belt side portions and that is continuous with a corresponding one of said right and left second stretchable portions;

the belt further including a third stretchable portion disposed between and operatively coupling the right and left low-stretchability portions to one another; and wherein stretchability decreases in the order of the first stretchable portion, the second stretchable portion, the third stretchable portion and the low-stretchability portion.

3. The upper underwear according to claim 1, wherein straps are attached to said cups and to said belt back portion.

4. The upper underwear according to claim 1, wherein each of said belt side portions has a side upper edge forming an upper edge thereof and a side lower edge forming a lower edge thereof, each of which is curved upwardly to describe a substantially partial ellipse.

5. The upper underwear according to claim 1, wherein said belt back portion is formed so as to position the lower edge thereof on scapulas.

6. The upper underwear according to claim 2, wherein straps are attached to said cups and to said belt back portion.

7. The upper underwear according to claim 2, wherein each of said belt side portions has a side upper edge forming an upper edge thereof and a side lower edge forming a lower edge thereof, each of which is curved upwardly to describe a substantially partial ellipse.

8. The upper underwear according to claim 2, wherein said belt back portion is formed so as to position the lower edge thereof on scapulas.

9. Upper underwear comprising:

right and left cups for accommodating respective breasts therein;

a belt joined to the left and right cups, the belt including left and right side portions arranged to be positioned on side parts of a body when the upper underwear is worn by a user, and a back portion arranged to be positioned on a back part of the body when the upper underwear is worn by the user;

the belt arranged such that when the upper underwear is disposed on a flat surface, with the belt folded along the side portions, a lower edge of the back portion is positioned above an upper extent of the left and right cups;

an intervening coupling member coupling a coupled portion of the right and left cups to one another, the coupling member arranged to maintain a positional relationship between the cups, the coupling member having a low stretchability;

the belt including a first portion disposed under the intervening coupling member and continuous with the coupled portion of the left and right cups, the first portion having a first stretchability;

the belt further including left and right second portions each continuous with an underside of the left and right cups and each joined to a corresponding left or right part of the first portion, the second portions having a second stretchability;

the left and right side portions each being continuous with a corresponding one of the left and right second portions;

the belt further including left and right third portions, each of the left and right third portions being continuous with a corresponding one of the left and right second portions, the left and right third portions arranged to be operatively coupled to one another along the back portion, the third portions having a third stretchability; and wherein the first stretchability is greater than the second stretchability, the second stretchability is greater than the third stretchability, and the third stretchability is greater than the low stretchability.

10. The upper underwear according to claim 9, wherein each of the left and right side portions has an upper edge and a lower edge, each of the upper edges and the lower edges being curved upwardly to describe a partial ellipse.

11. The upper underwear according to claim 9, wherein the back portion is sized and arranged to position the lower edge of the back portion on scapulas of the user when the upper underwear is positioned on the user.

* * * * *